US005542656A

United States Patent [19]

Stauber

[11] Patent Number: 5,542,656

[45] Date of Patent: Aug. 6, 1996

[54] APPARATUS FOR INDIVIDUALLY SEPARATING STACKED PRINTED PRODUCTS

[75] Inventor: Hans-Ulrich Stauber, Gruit, Switzerland

[73] Assignee: Ferag AG, Switzerland

[21] Appl. No.: 512,561

[22] Filed: Aug. 8, 1995

Related U.S. Application Data

[63] Continuation of Ser. No. 243,752, May 16, 1994, abandoned.

[30] Foreign Application Priority Data

May 21, 1993 [CH] Switzerland ..... 01 542/93

[51] Int. Cl.[6] ..... B65H 5/08

[52] U.S. Cl. ..... 271/11; 271/12; 271/95; 271/277

[58] Field of Search ..... 271/11, 12, 91, 271/95, 96, 108, 277

[56] References Cited

U.S. PATENT DOCUMENTS

| | | | |
|---|---|---|---|
| 3,386,558 | 6/1968 | Benatar | 271/12 |
| 3,831,930 | 8/1974 | Shimizu | 271/95 |
| 4,127,262 | 11/1978 | Eberle et al. | 271/12 |
| 4,279,412 | 7/1981 | Glatz | 271/108 |
| 4,518,301 | 5/1985 | Greenwell | 271/95 |
| 5,014,972 | 5/1991 | Anderson et al. | 271/3.1 |
| 5,054,761 | 10/1991 | Dietrich et al. | 271/12 |
| 5,092,576 | 3/1992 | Takahashi et al. | 271/3.1 |
| 5,169,285 | 12/1992 | Muller | 41/797.8 |

FOREIGN PATENT DOCUMENTS

| | | | |
|---|---|---|---|
| 0332828 | 1/1989 | European Pat. Off. | B65H 5/12 |
| 4029520 | 3/1992 | Germany | 271/91 |
| 2260123 | 4/1993 | United Kingdom | 271/12 |

*Primary Examiner*—H. Grant Skaggs
*Attorney, Agent, or Firm*—Brinks Hofer Gilson & Lione

[57] ABSTRACT

An apparatus for separating stacked printed products includes suction heads anchored on a rotor by a respective swivel arm. The swivel arms are driven with regard to their swivel position by a swiveling drive superposed on the rotary drive of the rotor such that they enter the takeover point in pushing operation and leave the latter in pulling operation. At the deflecting point, the suction heads have time to suck against the edge of the respectively outermost product; by their tilting movement at the deflecting point, the seized product edge is separated definitely and reliably from the neighboring product. In connection with a transporting-away device with grippers circulating successively one after the other, the edge of the products is placed into the grippers by the suction heads swiveled during the circulation.

14 Claims, 4 Drawing Sheets

APPARATUS FOR INDIVIDUALLY SEPARATING STACKED PRINTED PRODUCTS

This application is a continuation of application Ser. No. 08/243,752, filed May 16, 1994, now abandoned.

BACKGROUND OF THE INVENTION

The invention relates to an apparatus for individually separating stacked printed products and more particularly to an apparatus for separating printed products which uses a plurality of suction heads arranged on a rotor.

U.S. Pat. No. 5,169,285 and corresponding EP A1 0 332 828 describe an apparatus for individually separating stacked sheets of paper. The disclosed apparatus, is designed as a rotary feeder which includes a plurality of satellites arranged in a rotor. The satellites rotate about their own axis during the rotation of the rotor. They have drum sheaves, which are spaced from one another and between which suction heads are arranged. The rotor is located underneath a feeder magazine for receiving the stack. The drum sheaves of the satellites roll on the underside of the stack, so that the lowermost sheet, seized and temporarily held securely at the fold by the suction heads, is wound around the drum sheaves. The sheet is first drawn into a conveying nip which is formed at each satellite between the central drum sheaf and an endless conveyor belt which wraps partially around the central drum sheaf. The sheet is then pushed out on a path leading away tangentially from the drum sheaves and through the circumference of the rotor. The rotary feeder cooperates with a transporting-away conveyor with circulating grippers. The grippers take over the sheet of paper which is ejected from each of the satellites. This, however, works only if the fold is pushed out of the conveying nip as directly as possible into the gripper. This results in the sheet being pushed outward long after the fold is seized, i.e. it is considerably compressed and must therefore bow convexly. This deformation is abruptly reversed when the trailing edge leaves the conveying nip. In the case of thick sheets the limits of this arrangement are soon reached.

U.S. Pat. No. 4,127,262 and German Offenlegungsschrift 27 32 591 also describe a roller feeder which is likewise arranged underneath a stack magazine and in which a single suction head is arranged at one end of an angle lever. The other end is guided in a linear guide, and a swivel bearing is arranged eccentrically on a planetary gear. The planetary gear is driven in a circulating manner and part is in engagement with a fixed internal gear ring. This produces an angular orbit with a number of deflecting points for the suction head. One of these deflecting points lies in the takeover region.

Therefore, it is an object of the present invention to provide an apparatus which can separate a stacked product from a neighboring stacked product quickly and reliably.

SUMMARY OF THE INVENTION

To accomplish this and other objects, the apparatus of the present invention which separates stacked printed products comprises a rotor and a rotary drive which drives the rotor, and controllable suction heads that circulate in a plane which is perpendicular to the stack. The suction heads are mounted in the rotor. A drive is superposed on the rotary drive and individually moves the suction heads. The suction heads, in a takeover region, suck against the outer-most product and separate it from the stack to transfer the product to a transporting-away device. An anchor is provided for anchoring the suction heads to the rotor. The anchor includes a swivel arm which is substantially rigidly connected at one end to the suction head and has a free end. A follow-up control guides the free end of the swivel arm. The follow-up control has a follow-up roller which engages a control cam. The control cam is stationary and closes on itself. The swivel arms run into the take over point in a pushing operation and leave the take over point in pulling operation, in this manner, starting from the take over point, the swivel arms are driven in a swiveling manner forward in the direction of rotation and are thus held swiveled until delivery to the transporting-away device.

This arrangement is free from spatial constraints. It also permits the quick yet gentle reduction of a stack of products which are as thin or thick as desired, it being possible for the stack to be aligned to a great extent as desired.

In one embodiment, the arrangement of the present invention has a completely different approach with respect to both known feeders in that it is based on the object of arranging the suction heads outside a rotor and driving them in such a way that without any appreciable deformation even of a freely standing outermost product they can manage to separate it from the neighboring product quickly and reliably and can accomplish the transfer to the transporting-away device themselves.

Furthermore, in conjunction with a transporting-away device with circulating controlled grippers which are spaced one after the other at regular intervals, the apparatus of the present invention cam guide the suction heads with respect to the orbit of the grippers in such a way that they place the edge of the products seized by them into the grippers.

Additional objects, advantages and novel features of the invention will be set forth in part in the description which follows, and in part will become apparent to those skilled in the art upon examination of the following description or may be learned by practice of the invention. The objects and advantages of the invention may be obtained by means of the combinations particularly pointed out in the appended claims.

BRIEF DESCRIPTION OF THE DRAWINGS

An illustrative embodiment of the subject-matter of the invention with variants of the suction head mounting is represented diagrammatically in the attached drawings.

DETAILED DESCRIPTION OF THE PRESENTLY PREFERRED EMBODIMENTS

Figure 1:
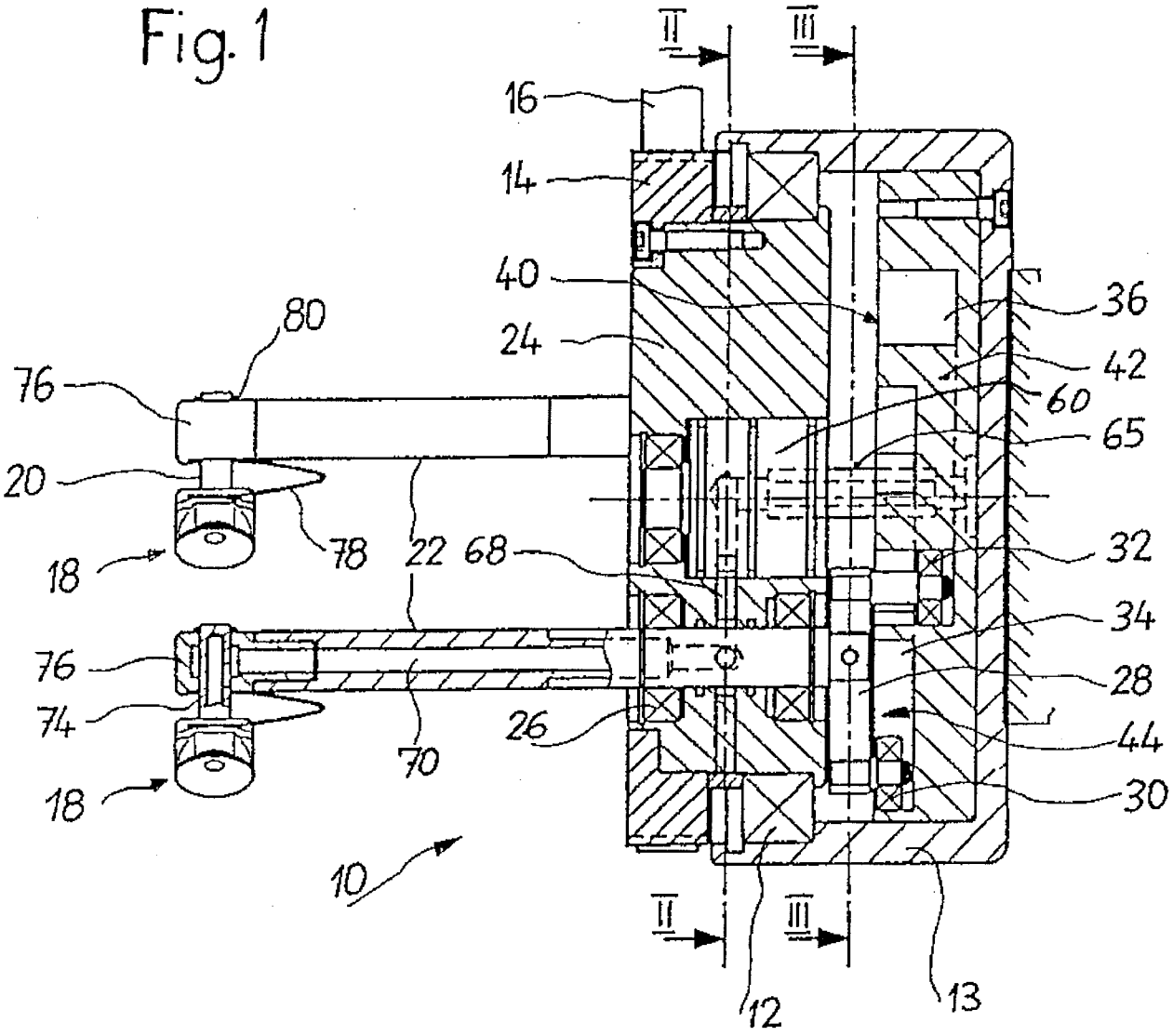
FIG. 1 shows in axial section of a preferred embodiment of the rotor with its rotating drive and the suction heads with their swiveling drive, and also the valve arrangement for controlling the suction heads, in a common housing.

As shown in FIG. 1, the rotor (denoted in its entirety by 10) is rotatably mounted by means of a roller-contact bearing 12 in a housing 13. The rotor 10 is driven in a rotating manner in the direction of rotation 88 by means of a gear ring 14 which is fastened on it and meshes with a toothed belt 16. Distributed rotationally, the rotor 10 bears three suction heads 18. Each of the suction heads 18 are anchored on a rotary disk 24 by a swivel arm 20 and a swivel spindle 22. The spindles 22 are mounted in the rotary disk 24 by rolling-contact bearings 26. The spindles 22 bear at their rear end, emerging from the rotor disk 24, a two-armed control lever 28. The control lever 28 includes follow-up rollers 30 and 32, respectively, arranged on the lever ends. Each of the follow-up rollers 30, 32 engage in one or the other of tracks 34, 36 of a control link or cam which closes on itself (denoted in its entirety by 38). The control link or cam 38 is located on the end face 40, facing the rotary disk 24, of an insert 42. The insert 42 is fastened in a removable manner in the housing 13. The track 36 is in this case lower than the other track 34. The follow-up rollers 32 and 30 are offset correspondingly with respect to each other in the axial direction. In this arrangement, each of the tracks 34 and 36 remain closed on themselves, even if they overlap. Thus, both tracks can run in their mutually diametrically opposed sections close to the center of the rotor. With little radial space requirement, this produces a precise and vibration-free swiveling drive 44 for the suction heads 18.

Figure 3:
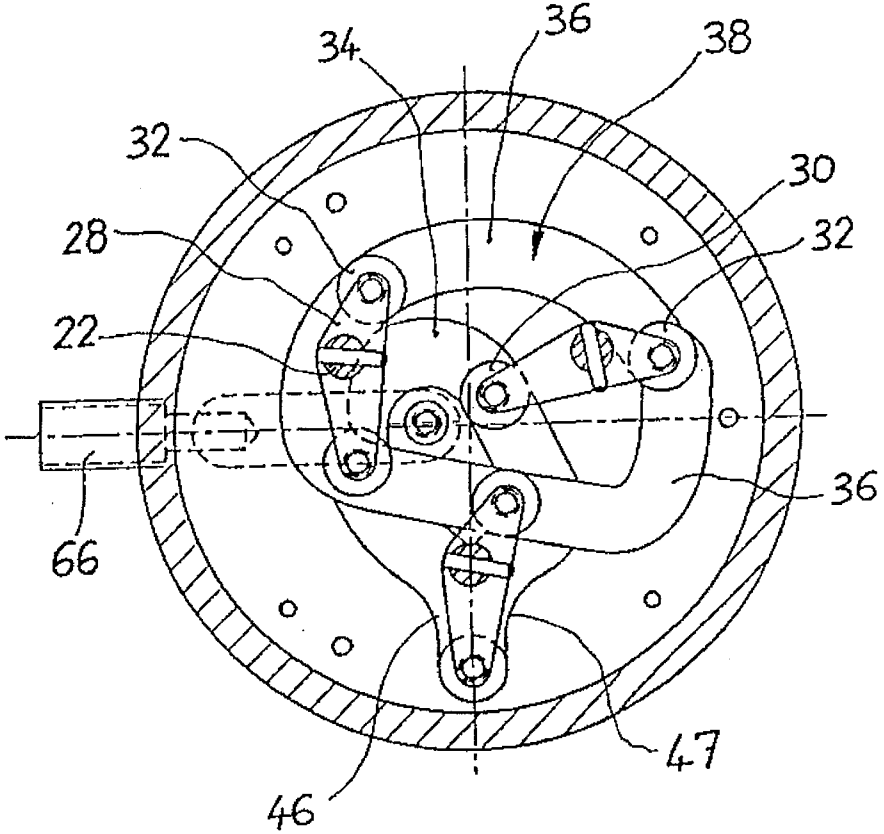
FIGS. 2 and 3 respectively show a section according to lines II and III of FIG. 1.

As FIG. 3 shows, the track 34 has a bulge 46. The bulge 46 reaches the arm of each control lever 28 (which interacts with this track 34 and bears the follow-up roller 30) in pushing operation and leaves it in pulling operation, since the relevant follow-up roller 30 is urged inward by the flank 47 of the bulge 46 which rises in the direction of rotation. The arrangement of the rotor 10 with respect to the stack (here above the upright stack 48) is set up such that the bulge 46 points toward the stack 48 and the relevant follow-up roller 30 comes closest to the stack 48 in the region of the bulge 46.

Figure 6:
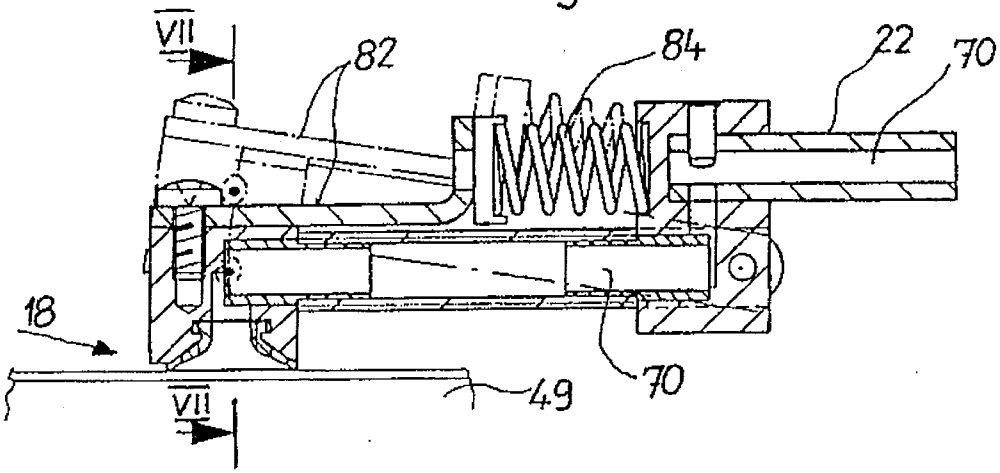
Figure 8:
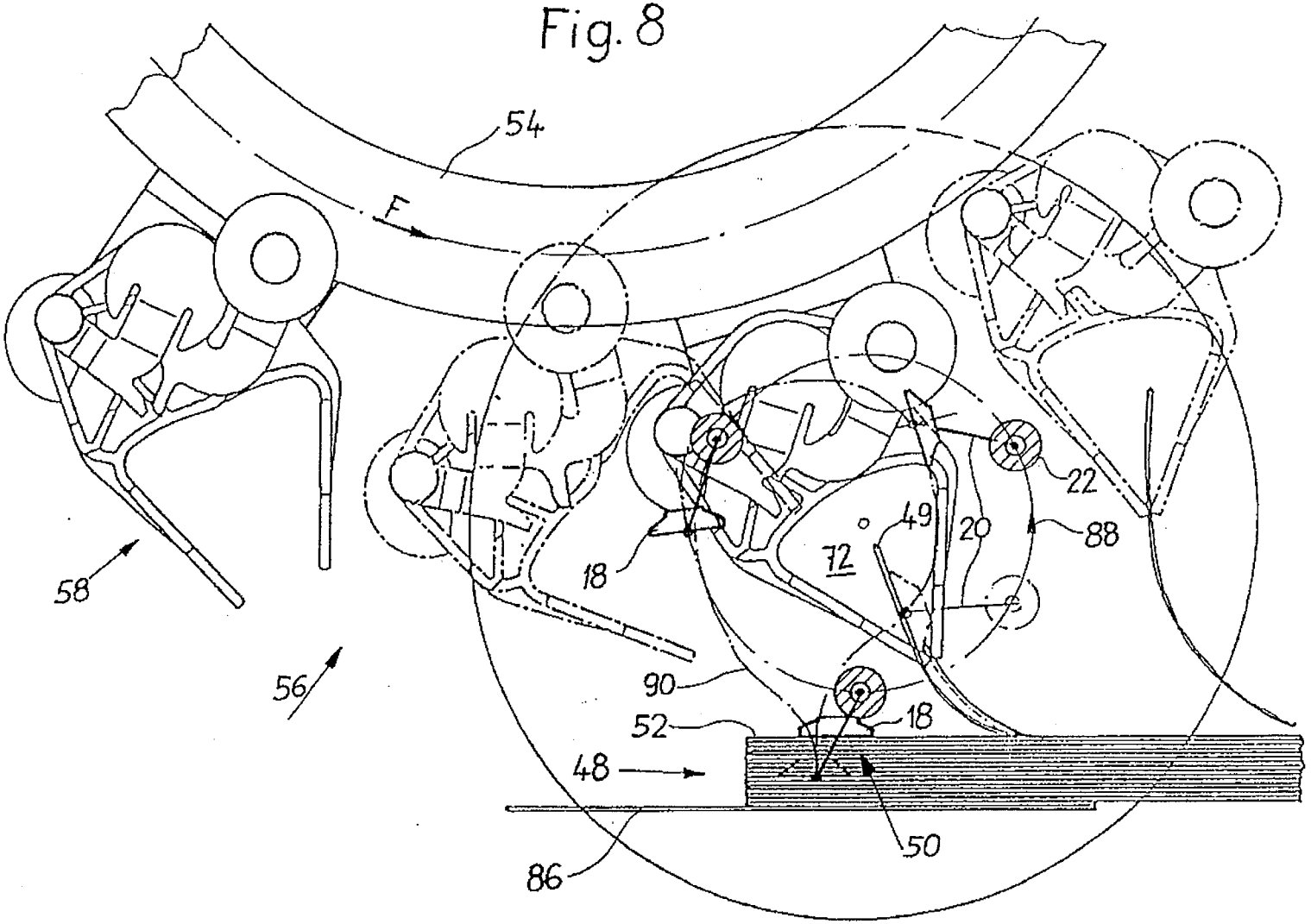
FIG. 8 shows the overall arrangement for reducing an upright stack, seen from the side.

As FIG. 8 shows, this is also true for the suction heads 18, since their swivel arms 20 extend from their spindles 22 substantially in the same sense as the arm of the control lever 28 which interacts with the track 34. Thus, the bulge 46 determines the takeover point 50 and the swivel arms 20 reach this takeover point 50 with their suction heads 18 being pushed and leave it with them being pulled. The orbit 90 of the suction heads 18 thus has a deflecting point. This results in the suction heads 18 having plenty of time during the change to suck against the edge of the outermost product 49 (FIG. 6). Further, since they leave the stack 48 in a tilting manner (as FIG. 8 shows), the suction heads 18 neatly separate the product edge from the neighboring product 52 (FIG. 8).

The suction heads 18 are preferably mounted in a resiliently repressible manner. This advantageously provides the takeover point 50 with a third dimension. This is explained in more detail below with reference to FIGS. 4–7.

As FIG. 8 further shows, above the stack 48 there is the guide channel 54 of a transporting-away device (denoted in its entirety by 56). This transporting-away device includes circulating controlling grippers 58 which are spaced one after the other at regular intervals. The controlling grippers 58 are anchored in a known way on an endless drawing member (not shown) which circulates in the channel 54 in the direction of conveyance F. The rotor 10 is laterally offset with respect to the channel 54. The suction heads 18, which swivel up at their swivel arms 20 and at the same time drive by their rotating spindles 22, thus hold the seized product edge longer and can place it directly into the downwardly facing mouth of the opened grippers 58 in a longer entry region. After this has taken place, the grippers 58 are closed and air is admitted to the suction heads 18.

Figure 2:
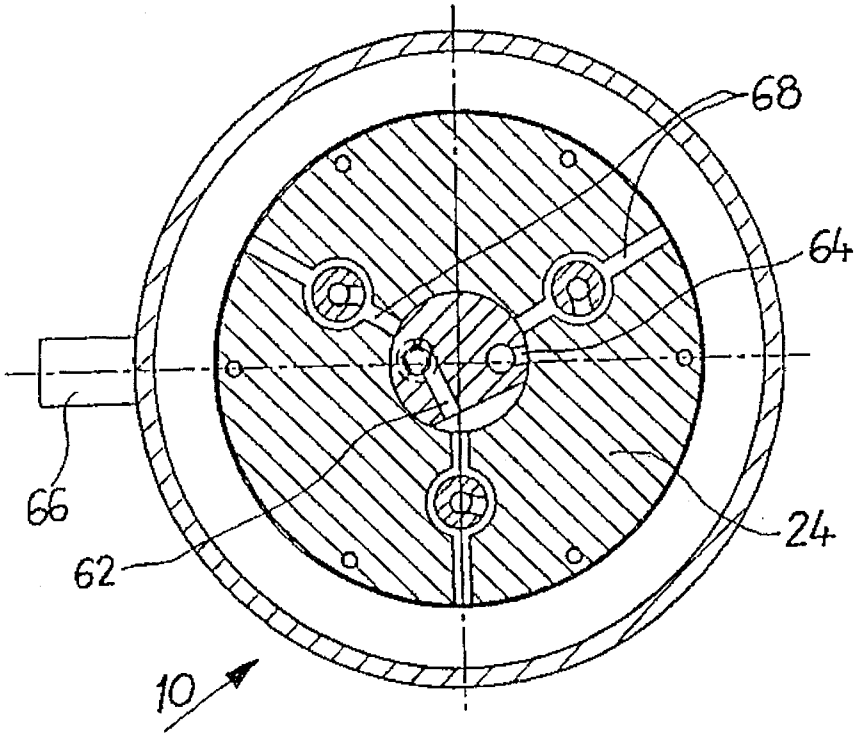

As best shown in FIGS. 1 and 2, for this purpose the rotor 10 (namely the rotor disk 24) comprises a rotary slide valve, which interacts with a valve body 60 engaging in a central opening of a rotor disk 24. The valve body 60 has control slits 62 and 64 which communicate with a vacuum source (not shown) and with the atmosphere, respectively. The connection 65 to a suction line 66 runs through the region of the insert 42 enclosed by the control link 38. Radial connecting channels 68 are provided in the rotary disk 24. During the course of a rotation of the rotor disk 24, these radial connecting channels come into connection first of all with the vacuum slit 62 and then with the air-admitting slit 64 (in a similar way to that also described in the German Offenlegungsschrift cited above). The radial connecting channels 68 of the rotor disk 24 are permanently connected to connecting channels 70 which are formed through the spindles 22 to the suction heads 18.

As FIG. 8 in conjunction with FIG. 3 shows, the path followed by the control link 38 and the distance between the suction heads 18 are chosen such that on the one hand the suction heads 18 travel around the transfer point 72 and on the other hand there are suction heads 18 both in the transfer region and in the takeover region. This permits a very fast mode of operation, particularly since considerable time is available both for the takeover and for the transfer and all movements of the operation take place in a flowing manner.

Figure 5:
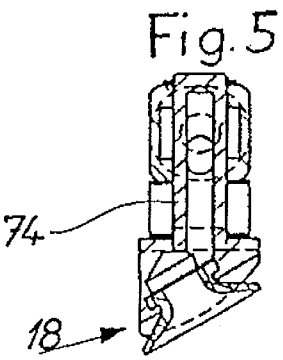
FIGS. 4–7 show variants of the suction head mounting in longitudinal section (FIGS. 4 and 6) and cross section (FIGS. 5 and 7).
Figure 4:
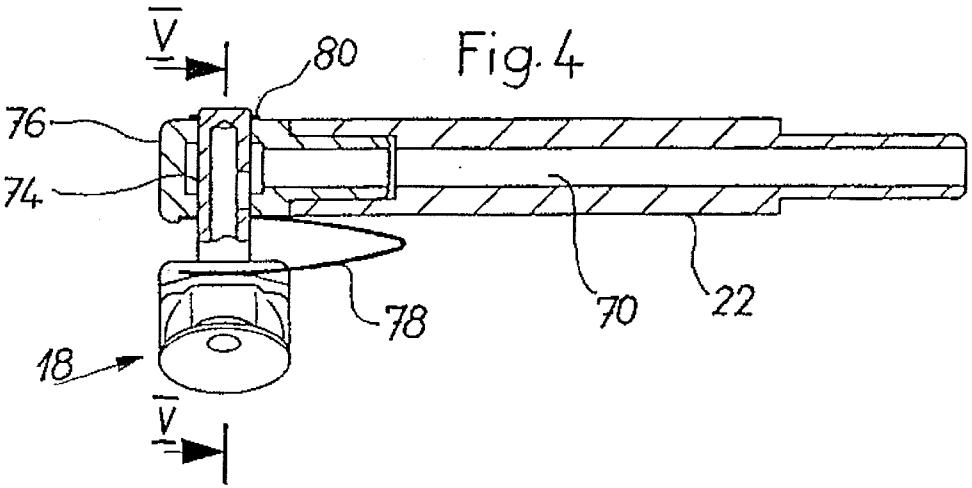

As already discussed, the resilient mounting of the suction heads is particularly useful. As shown in FIGS. 4 and 5, the suction heads 18 are attached on hollow pins 74. The hollow pins 74 are displaceably guided in heads 76 which are attached at the ends of the spindles 22. Under the action of a hairpin spring 78, however, the suction heads 18 assume a rest position determined by a stop shoulder 80. The hollow pins 74 communicate with the axial channels 70 of the spindles 22 in every displacement position of said hollow pins.

Figure 7:
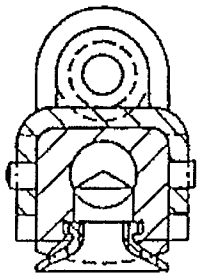

In the embodiment shown in FIGS. 6 and 7, the suction heads 18 are guided by means of hollow swivel arms 82, which are anchored on the spindles 22. A compression spring 84 holds the suction heads 18 in the stop position shown. Further details of both embodiments can be readily seen from the drawing. On the other hand, it should be expressly noted that the guides (here through 74 and 82) of the suction heads 18 are inclined in their takeover position in the direction of rotation. This permits longer contact of the suction heads 18 with the stack 48.

Since the individual separating can proceed at a very high speed of the rotor 10 and of the transporting-away device 56, the stack support is preceded—as indicated in FIG. 8—by a periodically or continuously driven feeding device 86. This periodically or continuously driven feeding device may be, for example, a conveyor belt.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above-teachings. It is intended that the scope of the invention be defined by the following claims, including all equivalents.

I claim:

1. An apparatus for individually separating stacked printed products, the apparatus comprising:

a rotor including a rotary drive for driving the rotor;

a plurality of controllable suction heads which circulate in a plane perpendicular to the stack, the suction heads being mounted in the rotor and individually moveable;

a drive superposed on the rotary drive for individually moving suction heads;

a takeover region having a takeover point wherein the suction heads suck against the outer-most product and separate it from the stack to transfer it to a transporting-away device at a transporting-away point;

a swivel arm, for each one of the suction heads, which anchors the suction head to the rotor, the swivel arm being substantially rigidly connected at one end on the suction head and having another end;

the drive comprising a follow-up control which guides the other end of the swivel arm, the follow-up control having a follow-up roller engaging a control cam including a track which is stationary and closed in itself; and the control cam configured such that the swivel arm runs into the takeover point in pushing operation and leaves the takeover point in pulling operation and such that starting from the takeover point, the swivel arm is driven in a swiveling manner forward in the direction of rotation and is held swiveled in pulling operation from the takeover point to the transporting-away point of the transporting-away device.

2. The apparatus as claimed in claim 1, wherein the rotor has a front side facing the swivel arm and a rear side opposed to the front side, and the follow-up control is arranged on the far side of the rotor, further comprising:

a control level bearing the follow-up roller; and a spindle connected to the swivel arm, the spindle passing through the rotor to the control lever.

3. The apparatus as claimed in claim 2, wherein the rotor comprises a rotary slide valve, which communicates via connecting channels with the suction heads and interacts with an assigned control surface of a valve body, and control slits provided on the control surface; the control slits connected to a vacuum source and to the atmosphere, respectively.

4. The apparatus as claimed in claim 3, wherein the spindle includes a channel connecting the rotor to the suction head.

5. The apparatus as claimed in claim 4, wherein the rotor includes a central opening and the valve body is disposed in the central opening of the rotor and is connected to the vacuum source by a line enclosed by the control cam.

6. The apparatus as claimed in claim 5, wherein the rotor includes a rotor housing and the control cam includes an insert which is fastened in a removable manner in the rotor housing and also bears the valve body.

7. The apparatus as claimed in claim 6, wherein:

the valve body is arranged at a distance in front of the insert;

the control cam includes, engaging partially under the valve body, an inner track and an outer track;

the control levers comprising two-armed control levers; and each control lever bearing on its one arm a follow-up roller for the inner track and on its other arm a follow-up roller for the outer track of the control cam.

8. The apparatus as claimed in claim 7, wherein one of the inner and outer tracks is lower than the other track.

9. The apparatus as claimed in claim 1, wherein the suction head is connected via the swivel arm to a swivel spindle in such a manner that it is allowed to resiliently move towards the swivel arm in a repressible manner.

10. An apparatus for individually separating stacked printed products, the apparatus comprising:

a rotor including a rotary drive for driving the rotor;

a plurality of controllable suction heads which circulate in a plane perpendicular to the stack, the suction heads being mounted in the rotor and individually moveable;

a drive superposed on the rotary drive for individually moving the suction heads;

a takeover region having a takeover point wherein the suction heads suck against the outer-most product and separate it from the stack to transfer it to a transporting-away device at a transporting-away point;

a swivel arm, for each one of the suction heads, which anchors the suction head to the rotor, the swivel arm being substantially rigidly connected at one end on the suction head and having another end;

the drive comprising a follow-up control which guides the other end of the swivel arm, the follow-up control having a follow-up roller engaging a control cam including a track which is stationary and closed in itself;

the control cam configured such that the swivel arms runs into the takeover point in pushing operation and leaves the takeover point in pulling operation and such that starting from the takeover point, the swivel arm is driven in a swiveling manner forward in the direction of rotation and is held swiveled in pulling operation from the takeover point to the transporting-away point of the transporting-away device;

wherein the transporting-away device includes circulating controlled grippers spaced one after the other at regular intervals; and wherein the path of movement of the grippers, facing substantially downward with the gripper mouth in the transfer region, runs above a stack support for an upright standing stack and is laterally offset with respect to the orbit of the suction heads and wherein the control cam includes a rising flank following after the takeover point, the suction head being swiveled up from the takeover point in the direction of the grippers into a transfer point.

11. The apparatus as claimed in claim 10 wherein the orbit of the suction heads is taken around the transfer point and the suction heads are spaced from one another such that there are suction heads both in the takeover point and in the transfer point.

12. The apparatus as claimed in claim 11, wherein the individual separation is continuous and the stack support is preceded by a feeding device driven continuously.

13. The apparatus as claimed in claim 11, wherein the individual separation is periodic and the stack support is preceded by a feeding device driven periodically.

14. An apparatus for individually separating stacked printed products, the apparatus comprising:

a rotor including a rotary drive for driving the rotor;

a plurality of controllable suction heads which circulate in a plane perpendicular to the stack, the suction heads being mounted in the rotor and individually moveable;

a drive superposed on the rotary drive for individually moving the suction heads;

a takeover region having a takeover point wherein the suction heads suck against the outer-most product and separate it from the stack to transfer it to a transporting-away device at a transporting-away point;

a swivel arm, for each one of the suction heads, which anchors the suction head to the rotor, the swivel arm being substantially rigidly connected at one end of the suction head and having another end;

the drive comprising a follow-up control which guides the other end of the swivel arm, the follow-up control having a follow-up roller engaging a control cam including a track which is stationary and closed in itself;

the control cam configured such that the swivel arm runs into the takeover point in pushing operation and leaves the takeover point in pulling operation and such that starting from the takeover point, the swivel arm is driven in a swiveling manner forward in the direction of rotation and is held swiveled in pulling operation from the takeover point to the transporting-away point of the transporting-away device; and wherein the rotor includes a rotor housing and the control cam includes an insert which is fastened in a removable manner in the rotor housing and also bears a valve body.

* * * * *

UNITED STATES PATENT AND TRADEMARK OFFICE

CERTIFICATE OF CORRECTION

PATENT NO. : 5,542,656

DATED : August 6, 1996

INVENTOR(S) : Hans-Ulrich Stauber

It is certified that error appears in the above-indentified patent and that said Letters Patent is hereby corrected as shown below:

On the Title Page

In line 1 of the inventor information, delete "Gruit" and substitute --Grüt--.

In line 1 under "FOREIGN PATENT DOCUMENTS", delete "1/1989" and substitute --2/1989--.

In claim 2, line 4, delete "far" and substitute --rear--.

In claim 10, column 6, line 19, delete "arms" and substitute --arm--.

Signed and Sealed this

Twenty-first Day of October 1997

Bruce Lehman

*Attest:*

BRUCE LEHMAN

*Attesting Officer*

*Commissioner of Patents and Trademarks*